US011774222B1

(12) United States Patent
Futtere

(10) Patent No.: US 11,774,222 B1
(45) Date of Patent: Oct. 3, 2023

(54) ALTERNATIVE BROADHEAD BLADE LOCK AND RELEASE APPARATUS AND METHOD

(71) Applicant: Matthew Futtere, Fredericksburg, TX (US)

(72) Inventor: Matthew Futtere, Fredericksburg, TX (US)

( * ) Notice: Subject to any disclaimer, the term of this patent is extended or adjusted under 35 U.S.C. 154(b) by 0 days.

(21) Appl. No.: 17/939,037

(22) Filed: Sep. 7, 2022

Related U.S. Application Data

(60) Provisional application No. 63/241,117, filed on Sep. 7, 2021.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 6,174,252 | B1 * | 1/2001 | Mizek | F42B 6/08 473/583 |
| 7,393,295 | B1 | 7/2008 | Futtere | |
| 7,713,152 | B1 * | 5/2010 | Tentler | F42B 6/08 473/583 |
| 8,043,177 | B2 * | 10/2011 | Flanagan | F42B 6/08 473/583 |
| 8,905,874 | B2 * | 12/2014 | Sullivan | F42B 6/08 473/583 |

* cited by examiner

*Primary Examiner* — John A Ricci
(74) *Attorney, Agent, or Firm* — J. Nevin Shaffer, Jr.

(57) ABSTRACT

An alternative broadhead blade lock and release apparatus and method consisting of a support body with a tip assembly with a nosetip. A blade is attached with the support body such that the blade is movable from a first position to a second position. A pressure device is connected with the blade where the pressure device is configured to pressure the blade to the second position and a locking pin is connected with the nosetip such that when the blade is connected with the locking pin the locking pin is in locking position and the blade is held in the first position by the pressure on the blade to the second position and where pressure on the blade toward the support body releases the blade from the locking pin such that the pressure device pressures the blade to rotate to the second position.

20 Claims, 5 Drawing Sheets

ALTERNATIVE BROADHEAD BLADE LOCK AND RELEASE APPARATUS AND METHOD

CROSS REFERENCE TO RELATED APPLICATION

This application claims the benefit of previously filed U.S. provisional patent application No. 63/241,117 filed Sep. 7, 2021 for an "Alternative Broadhead Blade Lock and Release Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to an alternative broadhead blade lock and release apparatus and method consisting of a support body with a tip assembly with a nosetip. A blade is attached with the support body such that the blade is movable from a first position to a second position. A pressure device is connected with the blade where the pressure device is configured to pressure the blade to the second position and a locking pin is connected with the nosetip such that when the blade is connected with the locking pin the locking pin is in locking position and the blade is held in the first position by the pressure on the blade to the second position and where pressure on the blade toward the support body releases the blade from the locking pin such that the pressure device pressures the blade to rotate to the second position.

BACKGROUND OF THE INVENTION

Humane hunting requires a system for killing prey quickly. Problems exist with current hunting devices, bows and arrows and projectiles in particular, in that, for example, the killing area of the arrow or projectile is difficult to expand without introducing detrimental side effects.

A "broadhead", as is known in the art, is the sharpened implement mounted on the end of the shaft of an arrow that provides the penetrating and cutting mechanism which results in the ethical and humane killing of the hunted animal. While broadheads are useful hunting tools, they would be even more useful if they could be accurately delivered to the desired area of the animal. The evolution of the broadhead has gone from fixed bladed designs to "mechanical" designs. The "mechanical broadheads" are mechanically complex devices which deploy cutting blades at impact with a target. In particular, the blades of all mechanical broadheads remain dependent upon removing forward momentum energy and transferring some of it for use in overcoming the restrictive devices placed upon the blades that are intended to prevent premature deployment. The amount of momentum energy that is required to overcome the prior art devices varies but is of a significant enough magnitude that it prevents ethical use of mechanical broadheads by those bow hunters shooting legal, but less poundage of pull bows.

In addition, the momentum energy removed from the forward motion to force blades to deploy delivers a direct and negative outcome to target recovery rates due to not obtaining an exit wound. This is especially critical on marginally hit animals. In short, typically, prior art designs are required to remove enough energy so as to generate enough force to overcome a large magnitude of friction, to break rubber bands, to shatter and/or permanently disfigure plastic collars, to cut through plastic pins or to cut O-rings. This reduction of energy reduces the efficacy of prior art mechanical blades with their one time use disposable blade holding mechanisms.

Further, with the advent and availability of improved materials, the bow or crossbow for delivering the arrow has also improved considerably. Compound bows and crossbows are much more efficient than traditional equipment and result in the capability to launch arrows at considerably higher velocities. Unfortunately, these higher velocities introduce significant acceleration forces upon the broadhead. Even a slight momentary opening of a blade and re-closure from a closure mechanism that uses an elastic material results in significant erratic accuracy. This is a major problem and has resulted in increasing the "strength" of the closure mechanisms. This, however, increases the amount of energy required to be used in defeating the closure mechanism and further compounds the problem by reducing penetrating power where lethality studies demonstrate improvement to recovery rates of hit animals when complete pass thru of the target animal is achieved.

In short, there is a need in the art for maintaining effective control of blades from transport in the field, absorption of launch energies at moment of shot taken, through air and at impact with the target animal. It is crucial to success to amplify the efficiency and effectiveness of the use of forward momentum energy. In addition, it is desirable to ensure maintenance of structural integrity through mechanical simplicity so as to provide a narrow profile in flight and a maximum cutting surface length while transiting the target animal while maximizing efficient use of the majority of the forward momentum energy and the stored kinetic energy to humanely impact, completely pass through and quickly and ethically kill the targeted game animal are also desirable.

It is appropriate to note that Applicant has created a superior broadhead blade and air flow equalizer apparatus and method as set forth in his U.S. Pat. No. 7,393,295 incorporated herein by reference. Further, Applicant has previously filed U.S. provisional patent application and subsequently a pending non-provisional application fora "Broadhead Blade Lock and Release Apparatus and Method" that describes a unique lock and release device. This non-provisional discloses an alternative lock and release mechanism that also enables three spaced apart blades, for example only and not by limitation, to be effectively and efficiently locked and released as will be described more fully herein.

As before, this invention is most particularly suited for a broadhead designed for use in hunting of big game birds and big game animals. Specifically, it is engineered to overcome the inherent problems noted with all other mechanical broadheads in pursuit of penetrating the chest cavity of big game animals. As a result, problems still exist in the art as set forth above for pursuing big game animals. As such there is a need in the art for an apparatus and method for use with structures such as arrows, projectiles and such, that increases the area of impact without decreasing the important aspects of accuracy and maximum penetration and lethal cutting upon impact and thru the target animal. That is, there is a need for a broadhead arrow, for example only, with a wide impact area that maintains target tip like accuracy at any arrow velocity, that incorporates the ability to transit bone structures such as a rib cage in a game animal in a manner that significantly minimizes the amount of momentum energy lost to penetration, minimizes deflection, that reduces lateral drag on the arrow shaft, and that provides broad, lethal cutting surface exposure at all times. Further there is a need for a broadhead that is able during hard bone structure penetration to pass it with minimal momentum energy loss, yet which presents maximum cutting width within soft tissue vital organs once the cutting surfaces transit past the harder chest cavity surfaces such as rib cage bones both during entry and exit of the chest cavity and that is able to again exit the ribbed chest cavity should hard bone be encountered attempting to prevent continued penetration. Further, a need exists for an easy to attach and failure resistant broadhead that maximizes mechanical simplicity of design and increased structural integrity and that does not act as a barb when withdrawn.

By way of further explanation, all mechanical broadheads require momentum energy removed from the finite energy transferred to them from the bow at release to penetrate an object to overcome the resistance of the various mechanisms used in prior art devices to hold blades closed from launch to impact. At impact with the target, movement of the blade is used to overcome the resistance mechanism used to prevent premature blade opening. Typical mechanisms used in the prior art are rubber bands, O-rings, plastic pins or plastic collars and similar friction inducing holding devices.

Such devices create problems, however. At launch from zero feet per second to some significantly higher feet per second, acceleration forces are applied to prior art designs that often cause momentary exposure of blade to air stream and/or complete breakdown of the holding mechanism resulting in full premature deployment of the blade or blades both of which cause a decrease in accuracy and penetrating force at impact.

In addition, through normal transport of broadheads in the field, blades can and are often bumped and banged or catch upon things. This often results in allowing momentary, partial to full, premature deployment prior to launch and creates additional problems. One prior art problem is safety due to exposing a user to cutting surfaces where none were expected. Additionally, accuracy issues are created by partial or full premature deployment of the blades. Further, a user is unable to use a projectile that has been prematurely deployed until replacement of the holding device. That is, many prior art devices are not reusable as they are designed to be sacrificial in nature. In fact, the majority of mechanical broadhead blade holding designs currently on the market must be totally replaced when stretched out of shape or when being damaged beyond use.

At minimum, the prior art devices often create a need to reset blades and/or to reach for another undamaged arrow during a time of being close upon the target animal which adds unnecessary movement and thus amplifies failure of the hunt through scaring off of the always vigilant target animal.

Applicant has observed that efficiency of forward momentum energy use is critical to achieve the desired complete pass through of a broadhead apparatus so as to enhance quick and humane killing of the target animal. The prior art designs all use the forward momentum contained within the arrow/broadhead projectile upon impact to transfer energy to initiate the release of the mechanical devices. It has been observed that a large component of the forward momentum energy is used to initiate and complete the mechanical motion required break the device and release the blades to a fully operational position. This limits to a large degree the possible distance of the forward penetrating potential of the projectile.

The magnitude of wasted forward momentum energy being converted to other mechanical motion eliminates and/or significantly inhibits the efficacy of these devices and reduces the choices and or use of the mechanical category of broadheads by those who use minimum legal draw weights. That is, some users must use those lower poundage bows to hunt with, such as women and young adults. This limitation also prevents those who can shoot higher poundage pull bows that deliver higher momentum energy from using the prior art mechanical broadheads. That is, Applicant knows that users are told by professional hunters and outfitters for larger animals such as elk, moose, eland, kudo, buffalo, etc that they are not allowed to use mechanical broadheads due to the inherent lack of penetration they deliver due to the problems of momentum energy wasted.

Thus, there is a need in the art for a process that addresses the aforementioned problems in a manner that is robust and flexible so as to accommodate a full spectrum of broadhead design and use.

It therefore is an object of this invention to provide an improved broadhead blade lock and release apparatus for increasing the penetrating power of a broadhead without reducing speed and accuracy and structural integrity.

SUMMARY

Accordingly, the novel broadhead blade lock and release apparatus and method utilizes the stored energy of an internal spring "pressure device" to provide locking force. The internal spring causes a blade or blades or plurality of blades to rotate away from a position that is specifically designed to connect at a locking location on a blade lock and continuously prevent the expansion of primary blade or blades when in the locked position. The mechanics of the interaction deliver a near zero use of forward momentum to unlock the blade or blades. It accomplishes this at impact by using the building pressure upon the blade edges toward the support structure. This minimum amount of energy is transferred to improve mechanical advantage to compress the blade slightly. This slight movement of compressing a blade or plurality of blades frees the mechanical connection of the blade with the blade lock. The blade lock, with or without secondary blades as will be described more fully hereafter, once disconnected from the blade is free to rotate, move linearly or move in a combination of ways, out of the way upon an axle or similar mechanism. Once the blade lock and/or secondary blade has rotated/moved free and into its final position, the main blade or plurality of main blades are pressured to open to full cutting width to deliver maximum lethal damage. The present invention thereby delivering the most efficient and effective use of all available forward momentum energy to achieve the maximum desirable pass thru potential.

As used herein all terms are given their common, "ordinary" meaning. In particular, the term "blade" is used as discussed herein and illustrated in the figures to describe a generally flat device which has a length, width and thickness and whose width and length are much larger than the thickness. A knife blade for example, only. The term "pressure device" is used herein to describe a device that is resilient and that deforms under pressure but returns to a resting state or position after pressure is withdrawn. A resilient metal spring, for example only, once formed stays in a resting position and when pressure is applied deforms and once the pressure is released, the spring returns to its resting position. The pressure device also exerts a pressure against movement or a resisting pressure when pressure is applied. Many metal and plastic devices are known which exhibit such qualities and are well within the abilities of those of ordinary skill in the art.

In another aspect of the invention, the at least one blade includes an interaction of a pressure contact device connected with the at least one blade. In another aspect, the connection of the pressure contact device holds the at least one blade at the first position. In another aspect, the pressure contact device is a ball bearing or similar lode bearing device which transfers stored spring energy to a blade or plurality of blades efficiently and with great minimization of wear surfaces via the friction induced via that mechanical interaction and repetitive motion.

According to another embodiment of the invention, a compressible cutting width broadhead apparatus includes two or more blades connected within a recess in a support structure where the two blades include a leading edge and a trailing edge and where the two blades are movable from a first position to a second position. A pressure device includes a first contact point and a second contact point such that one contact point is connected with each of the two blades where the pressure device maintains the two blades at the first position when no pressure is applied to the leading edges of the two blades and where the pressure device maintains contact with the two blades and yields when pressure is applied to the leading edge of a blade such that at least one blade moves to a third position and where when the pressure is removed from the leading edge the pressure device returns the blades to the first position.

In another aspect, the support structure includes a first end and a second end and where the first end is connected to an arrow shaft and where an arrow tip is connected with the second end. In a further aspect, the first position is a fixed position away from the support structure, the second position is a position toward the arrow tip away from the first position and the third position is a position inward from the first position toward the support structure.

In one aspect, the two blades include a slot or hole or locking recess within the blade or blades and/or trigger mechanism and the pressure device is connected with the two blades at either above or below the blade or plurality of blades.

In another aspect, the pressure device is a spring with a base topped with a hardened ball bearing or wear surface, a pressure contact device, connected with the blade or plurality of blades and placed under pressure. In one aspect, the locking mechanism is moved and or/rotated to pass through that region of interaction when pressure is removed from blade/plurality of blades at this position of the other blade/plurality of blades and/or trigger mechanism. The primary blade/plurality of blades are physically prevented from opening with the receptive geometrical shape of primary blade interacting with the receptive geometrical shape of the secondary blade/plurality of blades and/or trigger locking/release mechanism.

In another aspect, the pressure device is a spring with a base topped with a hardened ball bearing or wear surface is connected with the blade or plurality of blades and placed under pressure.

In one aspect, the locking mechanism is moved and or/rotated to pass through that region of interaction. When pressure is removed from blade/plurality of blades at this position of the other blade/plurality of blades and/or trigger mechanism the primary blade/plurality of blades are physically prevented from opening with the receptive geometrical shape of primary blade interacting with the receptive geometrical shape of the secondary blade/plurality of blades and/or trigger locking/release mechanism.

In another embodiment, the present invention pertains to broadhead blade lock and release apparatus comprising a support body and a tip assembly connected with the support body where the tip assembly includes a nosetip. A blade is attached with the support body such that the blade is movable from a first position to a second position. A pressure device is connected with the blade where the pressure device is configured to pressure the blade to the second position and a locking pin is connected with the tip assembly such that when the blade is connected with the locking pin the locking pin is in locking position and the blade is held in the first position by the pressure on the blade to the second position and where pressure on the blade toward the support body releases the blade from the locking pin such that the pressure device pressures the blade to rotate to the second position.

In one aspect, the tip assembly includes a spring and the spring contacts the locking pin and pressures the locking pin to the locking position.

In another aspect, the blade includes a length with a first end and a second end and a locking pin connector where the locking pin connector is configured to connect the blade in the first position with the locking pin in the locking position. In one aspect, the locking pin connector is a receiver slot in the blade and the locking pin is configured to fit within the receiver slot such that the blade is retained in the first position. In another aspect, the receiver slot includes a first edge and a second edge where the second edge extends past the first edge such that the second edge pushes away the locking pin as the blade moves toward the support structure.

In one aspect, the nosetip is moveably connected with the tip assembly such that the nosetip extends away from the tip assembly as the blade moves toward the support body.

In another aspect, the apparatus further includes more than one blade. In another aspect, the apparatus further includes three blades spaced apart around the support body.

According to another embodiment, a broadhead blade lock and release apparatus consists of a support body with a tip assembly with a nosetip where the nosetip is movably connected with the tip assembly. A blade is attached with the support body such that the blade is movable from a first position to a second position. A pressure device is connected with the blade where the pressure device is configured to pressure the blade to the second position. A locking pin with a rim is connected with the tip assembly such that when the blade is connected with the locking pin rim the locking pin is in locking position and the blade is held in the first position by the pressure on the blade to the second position and where pressure on the blade toward the support body releases the blade from the locking pin rim such that the pressure device pressures the blade to rotate to the second position and where the tip assembly includes a spring and the spring contacts the locking pin and pressures the locking pin to the locking position.

In one aspect, the blade includes a length with a first end and a second end and a locking pin connector where the locking pin connector is configured to connect the blade in the first position with the locking pin rim in the locking position.

In another aspect, the locking pin connector is a receiver slot in the blade and the locking pin rim is configured to fit within the receiver slot such that the blade is retained in the first position.

In one aspect, the receiver slot includes a first edge and a second edge where the second edge extends past the first edge such that the second edge pushes away the locking pin as the blade moves toward the support body.

In another aspect, the nosetip is moveably connected with the tip assembly such that the nosetip extends away from the support tip assembly as the blade moves toward the support body and pushes away the locking pin.

According to another embodiment, a broadhead blade lock and release apparatus consists of a support body and a tip assembly with a nosetip moveably connected with the support body where the tip assembly includes an external spring and an internal spring. A blade is attached with the support body such that the blade is movable from a first position to a second position and a pressure device is connected with the blade where the pressure device is configured to pressure the blade to the second position. A locking pin is movably connected with the tip assembly where the internal spring pressures the locking pin toward the blade such that when the blade is connected with the locking pin the locking pin is in locking position and the blade is held in the first position by the pressure on the blade to the second position and where pressure on the blade toward the support body releases the blade from the locking pin such that the pressure device pressures the blade to rotate to the second position and the external spring pressures the nose tip away from the support body.

In one aspect, the blade includes a length with a first end and a second end and a locking pin connector where the locking pin connector is configured to connect the blade in the first position with the locking pin in the locking position.

In another aspect, the locking pin connector is a receiver slot in the blade and the locking pin is configured to fit within the receiver slot such that the blade is retained in the first position.

In a further aspect, the receiver slot includes a first edge and a second edge where the second edge extends past the first edge such that the second edge applies pressure to the locking pin as the blade moves toward the support structure.

In one aspect, the apparatus includes more than one blade.

In another aspect, the apparatus includes three blades spaced apart around the support body. And, in a further aspect, the three blades are spaced apart around the support approximately 120 degrees from each other.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
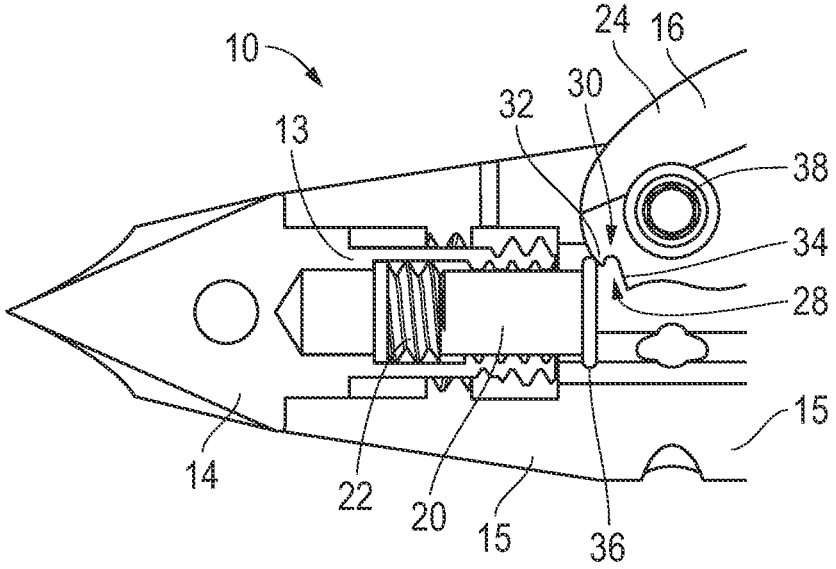
FIG. 1 is a side sectional view of the alternative broadhead blade lock and release apparatus of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of example in FIGS. 1-11.

Figure 2:
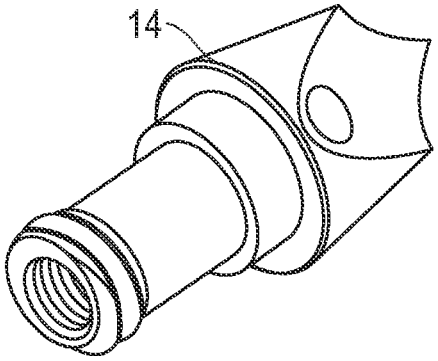
FIG. 2 is a perspective view of the nosetip of invention of FIG. 1.
Figure 3:
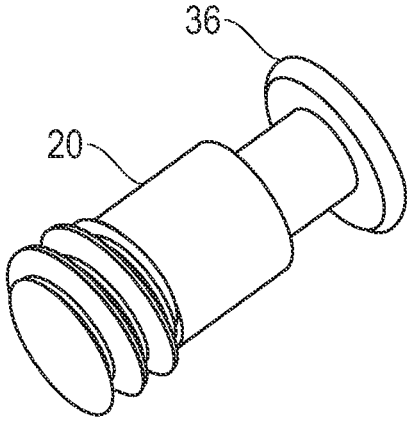
FIG. 3 is a perspective view of the locking pin of the invention of FIG. 1.
Figure 5:
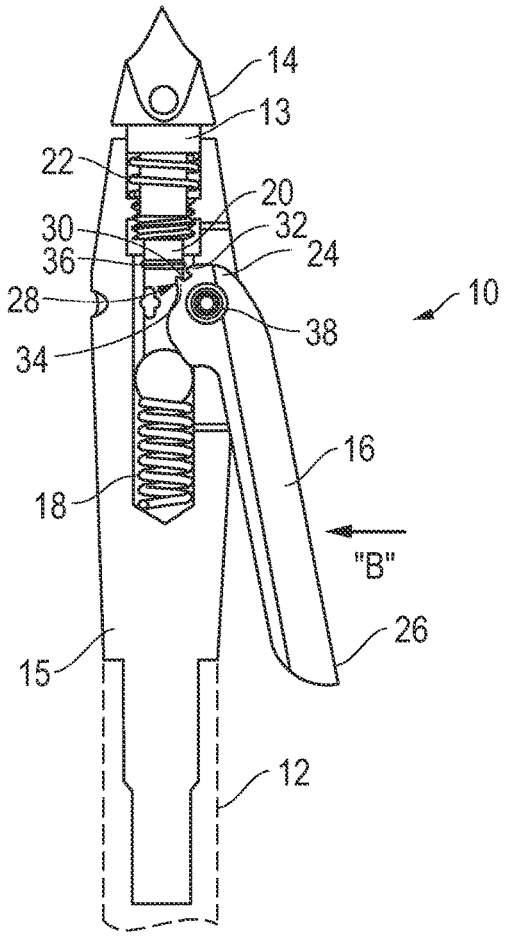
FIG. 5 is a side sectional view of the invention of FIG. 4 showing the blade being compressed toward the support structure and released from connection with the locking pin.
Figure 6:
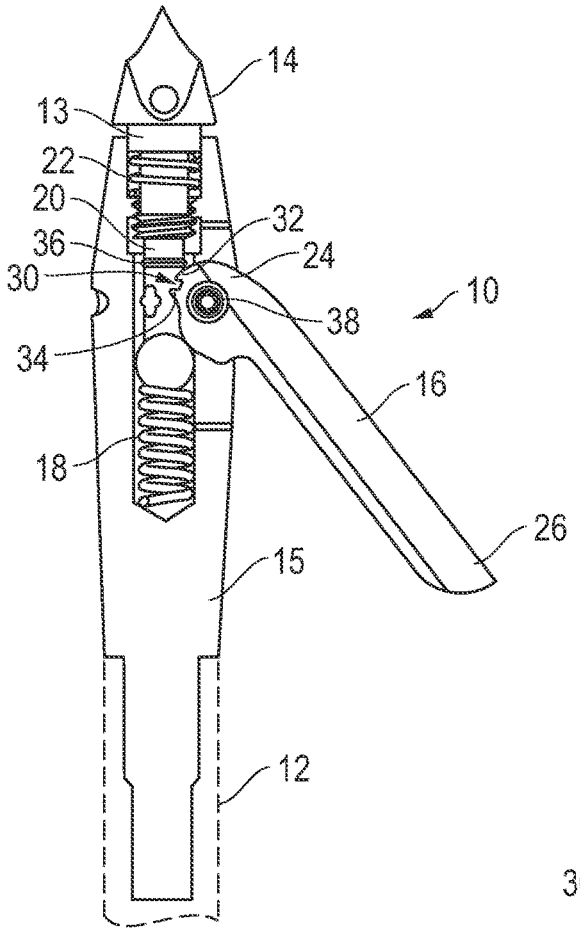
FIG. 6 is a side sectional view of the invention of FIG. 5 with the blade being pressured by the pressure device away from the support structure.

Referring to FIGS. 1, 2 and 3, an alternative broadhead blade lock and release apparatus and method 10 is constructed to fit on a support structure 12, such as an arrow shaft for example only, shown in dotted lines in FIGS. 5 and 6. Importantly, alternative broadhead blade lock and release apparatus includes a support body 15 and a tip assembly 13 with a nosetip 14. Nosetip 14 (See also FIG. 2) is connected at one end of the tip assembly 13 as shown and is the sharp, piercing point of an arrow, for example only.

Figure 7:
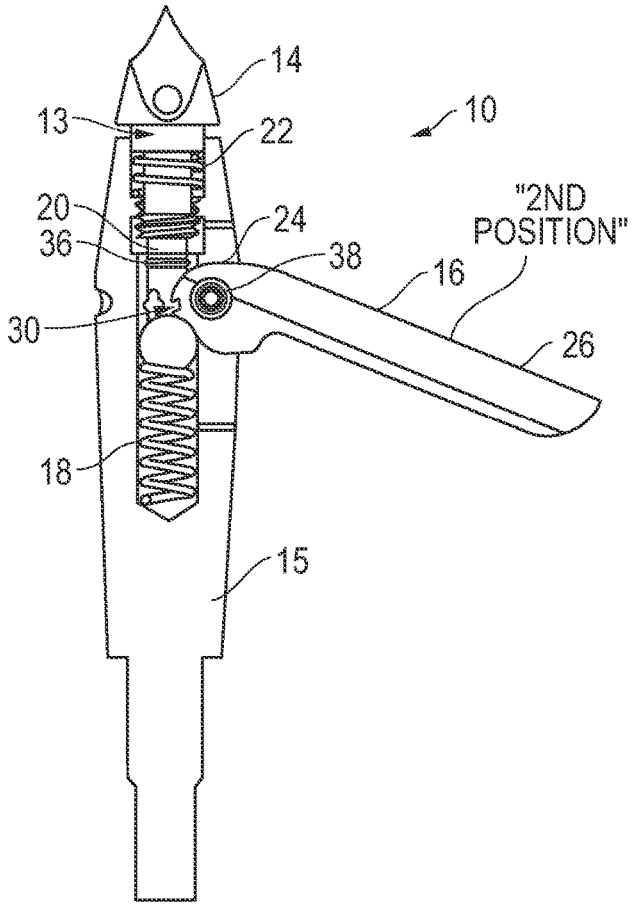
FIG. 7 is a side sectional view of the invention of FIG. 6 with the blade pressured to full extension away from the support structure.

A blade 16 is attached with the support body 15 such that the blade 16 is movable from a first position (See FIG. 4) to a second position (See FIG. 7). A pressure device 18 (See FIGS. 4-7) is connected with the blade 16 where the pressure device 18 is configured to pressure the blade 16 to the second position (See FIG. 7) all as will be more fully described hereafter.

Locking pin 20 (See FIG. 3) is connected with the tip assembly 13 such that when the blade 16 is connected with the locking pin 20 (See FIG. 4) the locking pin 20 is in locking position and the blade 16 is held in the first position by the pressure on the blade 16 to the second position. In operation, pressure on the blade 16 toward the support body 15, as when the blade 16 contacts a targeted item, a deer for example only, releases the blade 16 from the locking pin 20 such that the pressure device 18 pressures the blade 16 to rotate to the second extended position.

Figure 4:
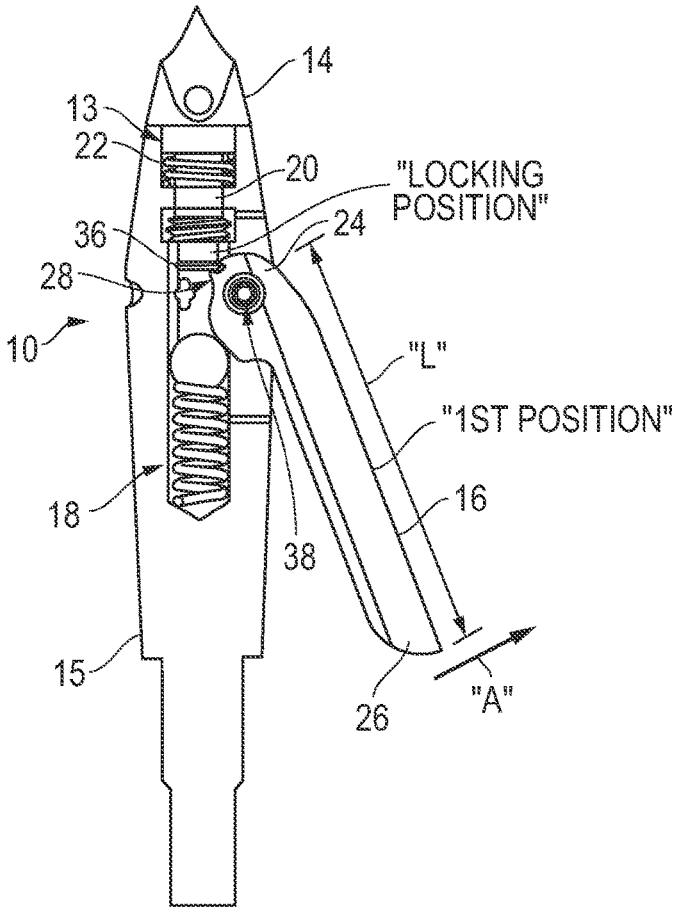
FIG. 4 is a side sectional view showing the blade connected with the locking pin in the locking position.

Referring to FIG. 4, the broadhead blade lock and release apparatus 10 is shown in the locked position with blade 16 in the first position connected with locking pin 20. Pressure device 18 is applying pressure to blade 16 such that the pressure is forcing the blade 16 in the direction of direction arrow "A". Again, blade 16 is held in the first position because of the connection of the blade 16 with locking pin 20.

FIG. 5 shows the effect on the blade 16 when pressure on the blade 16 in the direction of direction arrow "B" forces the blade 16 in towards support body 15. As blade 16 compresses, the connection with locking pin 20 is released and pressure device 18 then forces blade 16 away from support body 15 as shown in FIG. 6. FIG. 7 shows pressure device 18 holding blade 16 in the second position, fully extended away from support body 15.

In one aspect, the nosetip 14 includes a spring 22 (See also FIG. 1) and the spring 22 contacts the locking pin 20 and pressures the locking pin 20 to the locking position (See FIG. 4).

In another aspect, the blade 16, as shown in FIG. 4, for example, includes a length "L" with a first end 24 and a second end 26 and a locking pin connector 28 where the locking pin connector 28 is configured to connect the blade 16 in the first position with the locking pin 20 in the locking position.

Figure 10:
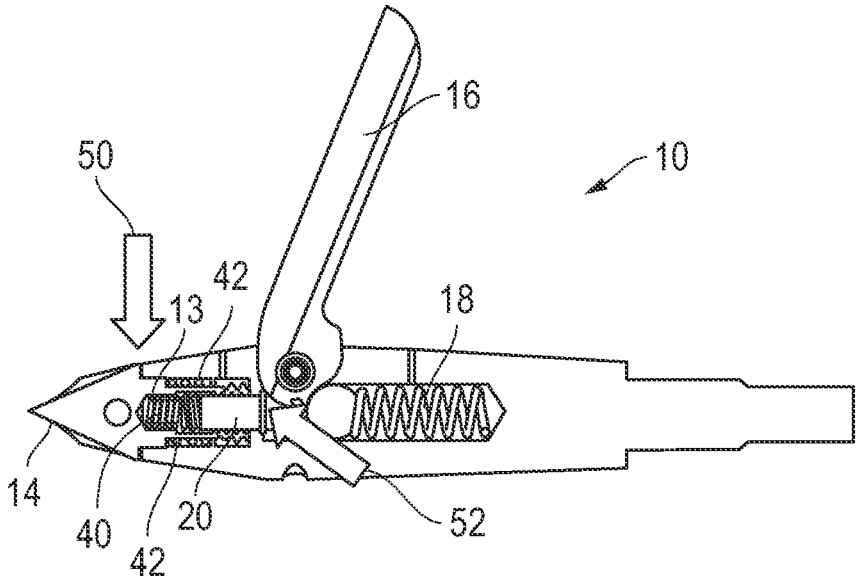
FIG. 10 is a side sectional view of the invention of FIG. 9 after impact with the moveable nosetip compressed against support body 15.

In one aspect, the locking pin connector 18 is a receiver slot 30, more clearly shown in FIGS. 1 and 10, in the blade 16 and the locking pin 20 is configured to fit within the receiver slot 30 such that the blade 26 is retained in the first position.

In another aspect, the receiver slot 30 includes a first edge 32 and a second edge 34 where the second edge 34 extends past the first edge 32 (See FIGS. 1 and 10) such that the second edge 34 pushes away the locking pin 20 as the blade 16 moves toward the support structure 12 (See FIG. 5).

In one aspect, the nosetip 14 is moveably connected with the support body 15 such that the nosetip 14 extends away from the support structure 12 (See FIGS. 5, 6, 7 and 9) as the blade 16 moves toward the support body 15.

Figure 8:
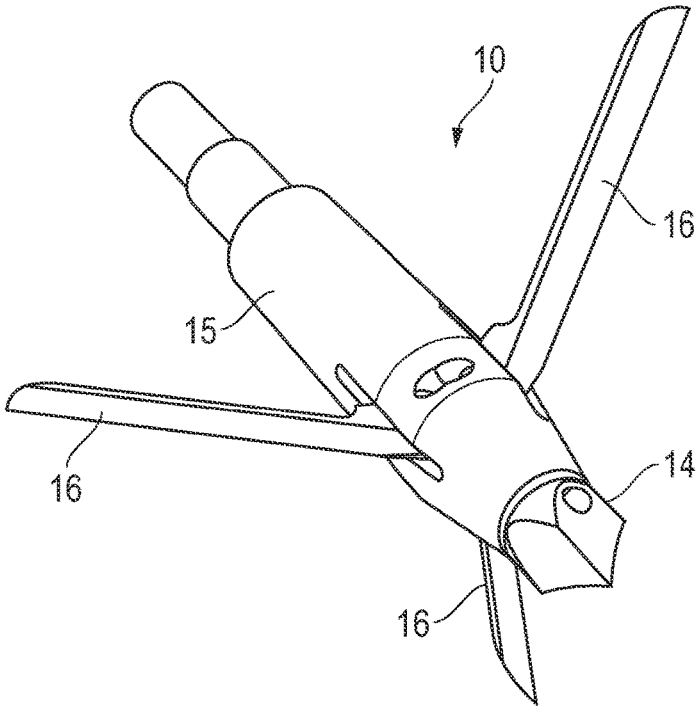
FIG. 8 is a perspective view of the invention of FIG. 1 with three blades spaced apart around the support structure.

In one aspect, the apparatus further includes more than one blade 16 and, in another aspect, the apparatus includes three blades 16 spaced apart around the support body 15 (See FIG. 8).

In one aspect, Referring to FIG. 1, the locking pin 20 has a rim 36, where the locking pin connector 28 of blade 16 is configured to connect the blade 16 in the first position with the locking pin 20 rim 36 in the locking position. That is the rim 36 provides a continuous locking ridge around one end of the locking pin 20 thereby ensuring blade (s) 16 can connect with the locking pin 20, no matter how many blades 16 are attached to the support body 15.

Figure 9:
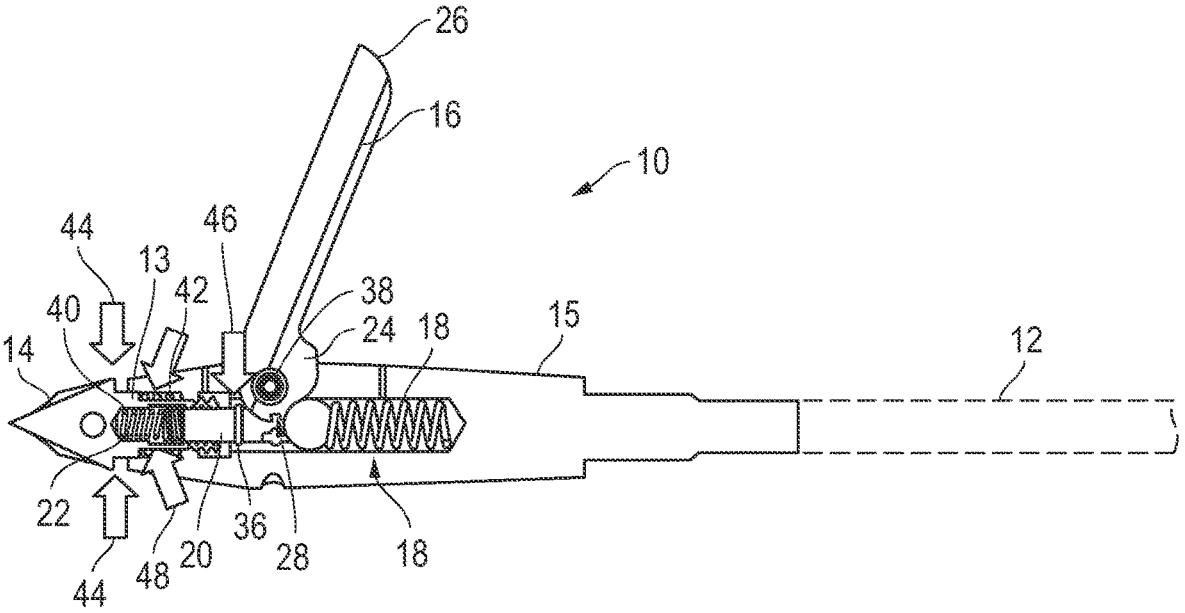
FIG. 9 is a side sectional view of the invention of FIG. 1 with a blade unlocked.
Figure 11:
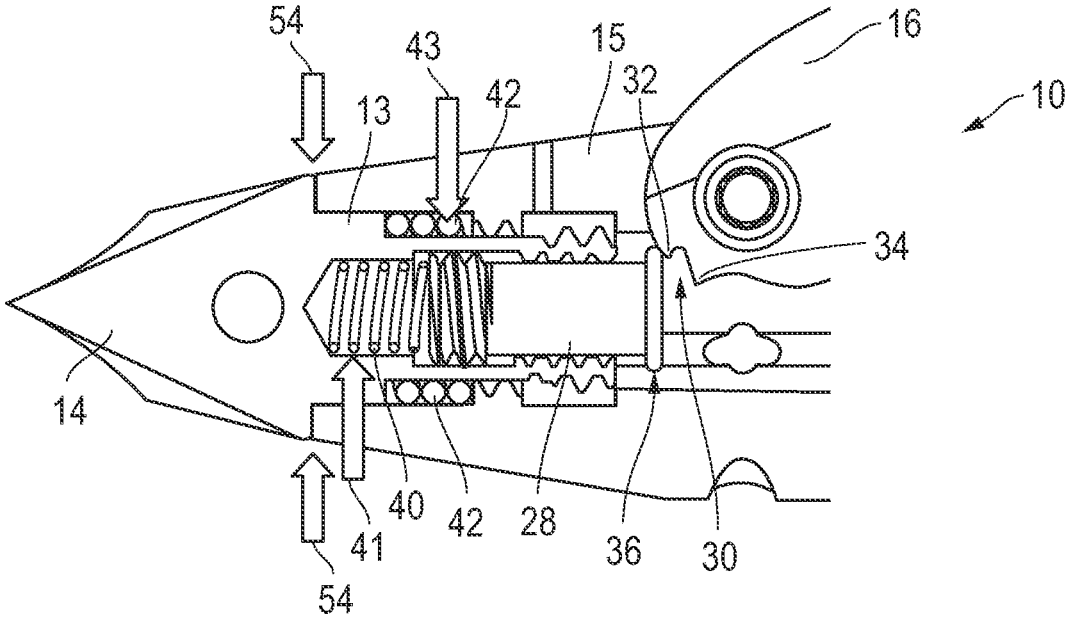
FIG. 11 is a close up view of the invention of FIG. 9 showing the internal spring and external spring and details of the tip assembly.

Referring now to FIGS. 9, 10 and 11, FIG. 9 shows blade 16 fully open. Normal operation will have all tip geometry, tip assembly 13 and nosetip 14, moved forward as shown. Notice the gap between support body 15 and nosetip 14 as indicated by arrows 44. Also shown in this embodiment is nosetip 14 external spring 42. External spring 42 moves the entire tip assembly 13, including the critical blade lock pin 20 geometry ahead of the area indicated by arrow 46. When occurring, as when the nosetip 14 encounters sufficient resistance upon entering a target, the secondary impact drives the entire tip assembly 13 geometry backwards. Applicant has determined by testing that if this blade lock pin geometry was a rigid one piece tip, any secondary impact would drive that sensitive geometry into the harder steel structure of the blades and permanently damage the blade lock pin 20.

To eliminate that potential, arrow 48 shows the internal spring 40 which allows compression of the blade lock pin 20 within the tip assembly 13. When the nosetip 14 is fully compressed against the tip assembly 13 as shown in FIGS. 10 and 11, as a result of the secondary impact, the nosetip 14 portion of the tip assembly 13 is driven backwards into the support body 15 fully. The lock pin 20 is driven forward as it is compressed against the open blade(s) 16. Once pressure is relieved from the nosetip 14 and entire tip assembly 13 moves forward. The tip internal spring 40 extends blade lock pin 20 back to the proper location so that blade(s) 16, when once again compressed can then achieve locking up with the lock pin 20 for another cycle of shot use.

Referring to FIG. 11, the secondary impact blade(s) 16 are open, extended, and nosetip 14 is fully compressed back against support body 15 as indicated via the arrow 50 position. With blade(s) 16 open and nosetip 14 compressed, arrow 52, shows that the critical geometry of locking pin 20 rides upon surface of blade(s) 16 but despite being forcibly compressed into the main tip geometry by secondary impact pressure, the locking pin 20 is allowed to compress internal spring 40 and move. This unique structure delivers 100% relief of pressure on geometry/pin so no critical pin geometry is damaged.

As soon as secondary impact pressure is relieved from nosetip 14, all springs, internal spring 40 and external spring 42, force components to return to full extension static position and ready for next cycle of use.

Referring now to FIG. 11, the locations where each spring, 40 and 42, resides is illustrated. The structure of the present invention ensures that under full compression, internal springs 40 and external springs 42 (arrows 41 and 43) cannot go "coil to coil" and over compress. In addition, impact energies are tremendous when the broadhead nosetip 14 strikes an object. To remove unwanted energy from transferring to small internal components such as springs and/or threaded areas which would destroy them in one shot, the major tip geometry (arrows 54) enables the present invention to compress so the major diameter flat of nosetip 14 mates up with the major diameter of the aluminum support body 15. This structure allows all energy to transfer to the largest structure and transmit to arrow/bolt shaft 12 (not shown) while not affecting any of the internal and far more fragile components.

By way of further description, Applicant has developed, for example only, a three blade broadhead that also encompasses unique momentum management, strength at impact, accuracy, etc. What is very unique to this blade design is the manner of how the mechanical difficulties relating to multiple, three, for example, blades radiating from the body at approximately 120 degrees apart, for example only and not by limitation, are solved. With the blades in the closed, locked position the broadhead is in a "Ready to shoot" position. As described herein, the structure of the present invention uses the compression of the blades slightly to "Unlock" the blades from the locking pin 20 as the projectile is moving forward at impact and continued penetration. To achieve complete unlocking of all blades 16, the tip geometry/post, i.e. the nosetip 14 needs to move forward in opposition to the pressure exerted on the nosetip 14 during penetration. The secondary internal spring force provided by pressure device 18 alone is not sufficient to overcome the pressure exerted on the nosetip 14 during this penetration. To overcome this problem, the present invention uses lever principles of a longer lever, with the fulcrum point being the blade 16 mounting axle/set screw 38 (See, eg, FIG. 1) and lifting point extension on the lower part, the second edge 34, of the blade 16 lock locking pin connector 28 to physically push upon the base of the locking pin 20 to move it forward toward the nosetip 14 in opposition to far greater and opposing penetration force pushing against nosetip 14. Note the geometry of lower portion, second edge 34 of the blade 16 locking pin connector 28. In a preferred embodiment, this second edge 34 provides a lower "Lip" that extends farther than the upper lip, first edge 32. The second edge 34 acts as the lever end that pushes upon the bottom of the locking pin 20. Thereby in a dual sense of roles simultaneously, the present invention uses the compressive pressure force exerted on the main length of the blades 16 to mechanical advantage to ensure that the nosetip 14 and locking pin 20 is mechanically moved forward assisting the secondary spring, pressure device 18, to keep the nosetip 14 forward and the locking pin 20 clear during the "blade unlock" sequence (See FIGS. 4-6).

Once blades 16 are unlocked and opened beyond a point so as to have internal main spring, pressure device 18, force rotation to move the blade locking geometry, locking pin connector 28, away from locking pin 20, the nosetip 14 and locking pin 20 can then return to their original positions again without potential of re-locking as the blade geometry specific location of locking geometry is rotated beyond ability to interact with blade locking pin connector 28 as shown in FIG. 7.

Again, the present invention pertains to an alternative broadhead blade lock and release apparatus 10 consisting of a support structure 12 with a blade 16 rotatably attached with the support structure 12 such that the blade 16 is movable from a first position to a second position. A pressure device 18 is connected with the blade 16 where the pressure device 18 is configured to apply pressure to the blade 16. A locking pin 20 is connected with the support structure 12 such that when the blade 16 is connected with the locking pin 20 the blade 16 is held in the first position by the mechanical dimensions interaction between the round locking pin 20 and blade 16 locking pin connector 28. Pressure from the main internal spring, pressure device 18, upon the blade 16, when pressure on the blade 16 toward the support structure 12 releases the blade 16 from the locking pin 20, then pressures the blade 16 to rotate to the second position. The locking pin 20 by means of the mechanical leverage force from the lower portion, second edge 26 of the receiver slot 30, aided by internal spring pressure device 18, moves the nosetip 14 and locking pin 20 forward to completely release blade/blades 16 to enjoy independent blade freedom of movement and minimal opportunity for unwanted relocking of blades to the locking pin 20. At that point, blades 16 are unlocked and free to open to full cut width. Importantly, each blade 16 is independently are free and if one blade 16 is unlocked all the other blades 16, when present, unlock as well. For resetting to use again, the round shape of the locking pin 20 allows a blade 16 or plurality of blades 16 to engage simultaneously and at any rotational position of the nosetip 14 and locking pin 20 to enjoy ease of achieving solid mechanical lock up that will not ever allow prematurely release of blades 16.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A broadhead blade lock and release apparatus comprising:

a. a support body;

b. a tip assembly connected with the support body wherein the tip assembly includes a nosetip;

c. a blade attached with the support body such that the blade is movable from a first position to a second position;

d. a pressure device connected with said blade wherein said pressure device is configured to pressure said blade to the second position; and e. a locking pin connected with the tip assembly such that when the blade is connected with the locking pin said locking pin is in locking position and said blade is held in the first position by the pressure on the blade to the second position and wherein pressure on the blade toward the support body releases the blade from the locking pin such that the pressure device pressures the blade to rotate to the second position.

2. The apparatus of claim 1 wherein the tip assembly includes a spring and the spring contacts the locking pin and pressures the locking pin to the locking position.

3. The apparatus of claim 1 wherein the blade includes a length with a first end and a second end and a locking pin connector wherein the locking pin connector is configured to connect the blade in the first position with the locking pin in the locking position.

4. The apparatus of claim 3 wherein the locking pin connector is a receiver slot in the blade and the locking pin is configured to fit within the receiver slot such that the blade is retained in the first position.

5. The apparatus of claim 4 wherein the receiver slot includes a first edge and a second edge wherein the second edge extends past the first edge such that the second edge applies pressure to the locking pin as the blade moves toward the support structure.

6. The apparatus of claim 5 wherein the nosetip is moveably connected with the tip assembly such that the nosetip extends away from the tip assembly as the blade moves toward the support body.

7. The apparatus of claim 1 further including more than one blade.

8. The apparatus of claim 1 further including three blades spaced apart around the support body.

9. A broadhead blade lock and release apparatus comprising:

a. a support body with a tip assembly with a nosetip wherein the nosetip is movably connected with the tip assembly;

b. a blade attached with the support body such that the blade is movable from a first position to a second position;

c. a pressure device connected with said blade wherein said pressure device is configured to pressure said blade to the second position; and d. a locking pin with a rim, the locking pin connected with the tip assembly such that when the blade is connected with the locking pin rim said locking pin is in locking position and said blade is held in the first position by the pressure on the blade to the second position and wherein pressure on the blade toward the support body releases the blade from the locking pin rim such that the pressure device pressures the blade to rotate to the second position and wherein the tip assembly includes a spring and the spring contacts the locking pin and pressures the locking pin to the locking position.

10. The apparatus of claim 9 wherein the blade includes a length with a first end and a second end and a locking pin connector wherein the locking pin connector is configured to connect the blade in the first position with the locking pin rim in the locking position.

11. The apparatus of claim 10 wherein the locking pin connector is a receiver slot in the blade and the locking pin rim is configured to fit within the receiver slot such that the blade is retained in the first position.

12. The apparatus of claim 11 wherein the receiver slot includes a first edge and a second edge wherein the second edge extends past the first edge such that the second edge pressures the locking pin as the blade moves toward the support body.

13. The apparatus of claim 12 wherein the nosetip is moveably connected with the tip assembly such that the nosetip extends away from the support tip assembly as the blade moves toward the support body and pushes away the locking pin.

14. A broadhead blade lock and release apparatus comprising:

a. a support body;

b. a tip assembly with a nosetip moveably connected with the support body where the tip assembly includes an external spring and an internal spring;

c. a blade attached with the support body such that the blade is movable from a first position to a second position;

d. a pressure device connected with said blade wherein said pressure device is configured to pressure said blade to the second position; and d. a locking pin movably connected with the tip assembly wherein said internal spring pressures said locking pin toward said blade such that when the blade is connected with the locking pin said locking pin is in locking position and said blade is held in the first position by the pressure on the blade to the second position and wherein pressure on the blade toward the support body releases the blade from the locking pin such that the pressure device pressures the blade to rotate to the second position and said external spring pressures said nose tip away from said support body.

15. The apparatus of claim 14 wherein the blade includes a length with a first end and a second end and a locking pin connector wherein the locking pin connector is configured to connect the blade in the first position with the locking pin in the locking position.

16. The apparatus of claim 15 wherein the locking pin connector is a receiver slot in the blade and the locking pin is configured to fit within the receiver slot such that the blade is retained in the first position.

17. The apparatus of claim 16 wherein the receiver slot includes a first edge and a second edge wherein the second edge extends past the first edge such that the second edge applies pressure to the locking pin as the blade moves toward the support structure.

18. The apparatus of claim 14 further including more than one blade.

19. The apparatus of claim 14 further including three blades spaced apart around the support body.

20. The apparatus of claim 19 wherein the three blades are spaced apart around the support approximately 120 degrees from each other.

* * * * *